US009726008B2

(12) United States Patent
White et al.

(10) Patent No.: US 9,726,008 B2
(45) **Date of Patent: *Aug. 8, 2017**

(54) SUB-SURFACE FORMATION BOUNDARY DETECTION USING AN ELECTRIC-FIELD BOREHOLE TELEMETRY APPARATUS

(71) Applicants: Matthew A. White, Templeton, CA (US); Asong E. Suh, Spring, TX (US); Stephan Graf, Paso Robles, CA (US)

(72) Inventors: Matthew A. White, Templeton, CA (US); Asong E. Suh, Spring, TX (US); Stephan Graf, Paso Robles, CA (US)

(73) Assignee: Scientific Drilling International, Inc., Houston, TX (US)

( * ) Notice: Subject to any disclaimer, the term of this patent is extended or adjusted under 35 U.S.C. 154(b) by 271 days.

This patent is subject to a terminal disclaimer.

(21) Appl. No.: 14/544,278

(22) Filed: Dec. 19, 2014

(65) Prior Publication Data

US 2015/0101817 A1 Apr. 16, 2015

Related U.S. Application Data

(63) Continuation of application No. 13/200,613, filed on Sep. 26, 2011.

(51) Int. Cl.
*E21B 7/04* (2006.01)
*E21B 7/06* (2006.01)
(Continued)

(52) U.S. Cl.
CPC ..... *E21B 47/121* (2013.01); *E21B 7/046* (2013.01); *E21B 7/068* (2013.01); *E21B 7/10* (2013.01);
(Continued)

(58) Field of Classification Search
CPC ..... E21B 47/02; E21B 47/02216; E21B 47/02224; E21B 47/026; E21B 47/09;
(Continued)

(56) References Cited

U.S. PATENT DOCUMENTS 6,396,276 B1 * 5/2002 Van Steenwyk ..... E21B 47/122 175/50
8,044,819 B1 * 10/2011 Bessiere ..... E21B 47/06 340/853.3
(Continued)

FOREIGN PATENT DOCUMENTS

WO WO 2011043851 A1 * 4/2011 ..... E21B 7/04

*Primary Examiner* — Hai Phan
*Assistant Examiner* — Franklin Balseca
(74) *Attorney, Agent, or Firm* — Adolph Locklar

(57) ABSTRACT

The method of maintaining drill bit advancement in an underground formation that contains shale, including providing an electrical signal from an insulated gap location in a drill string substantially directly behind the bit in the formation, detecting substantial change in a signal as the bit advances, and changing the direction of drilling of the bit as a function of a signal change, to thereby maintain the direction of bit advancement in the formation.

A method is disclosed for detecting the existence and direction of adjacent bed boundaries. A short hop transmitter assembly generates a signal that is detected by an associated receiver assembly. The received signal(s) are tied to the azimuthal orientation of the transmitter or receiver and processed to yield the direction and/or the distance of the bed boundary. This information is transmitted to the surface via surface telemetry for real-time control of the drilling assembly to stay within, or to enter, a pay zone.

12 Claims, 20 Drawing Sheets

(51) Int. Cl.

| | |
|---|---|
| ***E21B 7/10*** | (2006.01) |
| ***E21B 47/02*** | (2006.01) |
| ***E21B 47/022*** | (2012.01) |
| ***E21B 47/026*** | (2006.01) |
| ***E21B 47/12*** | (2012.01) |

(52) U.S. Cl.
CPC ..... *E21B 47/02* (2013.01); *E21B 47/026* (2013.01); *E21B 47/02216* (2013.01); *E21B 47/02224* (2013.01); *E21B 47/12* (2013.01); *E21B 47/122* (2013.01)

(58) Field of Classification Search
CPC .... E21B 47/0905; E21B 47/12; E21B 47/121; E21B 47/122; E21B 7/046; E21B 7/068; E21B 7/10
USPC ..... 340/853.1, 853.6, 853.8, 854.1, 854.2, 340/854.6
See application file for complete search history.

(56) References Cited

U.S. PATENT DOCUMENTS

2005/0212520 A1* 9/2005 Homan ..... G01V 3/30 324/338
2007/0158073 A1* 7/2007 Green ..... E21B 41/0035 166/313

* cited by examiner

Surface Electronics
1
5a
5
5b
5c
4
6a
6b
2
3
6c
6d
+V=V
8a
10b
10a
9
8
7a
7
~6f~
6e SIGNAL VARIATION AT THE GAP WITH 1 Ωm MUD FOR 1, 10 AND 100 Ωm SHOULDER RESISTIVITY WITH 1 FT. DISTANCE TO THE BOUNDARY.

SIGNAL VARIATION AT THE GAP WITH 1 Ωm MUD AND SHOULDER BED RESISTIVITY AND 20 Ωm BED RESISTIVITY FOR 1 AND 0.5 FT. DISTANCE TO THE BOUNDARY.

SIGNAL VARIATIONS AT THE GAP WITH 1 Ωm MUD AND 20 Ωm & 1 Ωm BED RESTIVITY AND 1 Ωm & 20 Ωm SHOULDER BED RESISTIVITY FOR 0.5 FT. DISTANCE TO THE BOUNDARY.

SIMULATED SIGNAL AT THE GAP WITH 1 Ω m MUD AND SHOULDER BED RESISTIVITY AND 20 Ωm BED RESTIVITY FOR VARIABLE DISTANCE TO THE BOUNDARY

SIGNAL VARIATION BETWEEN UP AND DOWN AT THE GAP WITH 1 Ωm MUD AND SHOULDER BED RESISTIVITY AND 20 Ωm BED RESISTIVITY FOR VARIABLE DISTANCE TO THE BOUNDARY.

CURRENT DENSITY PLOT OF THE LENGTHWISE CROSS-SECTION OF THE DRILL STRING WITH THE SMART MOTOR ELECTROE FACING AWAY FROM THE BOUNDARY.

CURRENT DENSITY PLOT OF THE LENGTHWISE CROSS-SECTION OF THE DRILL STRING WITH THE SMART MOTOR ELECTRODE FACING TOWARDS THE BOUNDARY.

CURRENT DENSITY PLOT OF THE CROSS-SECTION WITH THE SMART MOTOR ELECTRODE FACING AWAY FROM THE BOUNDARY.

CURRENT DENSITY PLOT OF THE CROSS-SECTION WITH THE SMART MOTOR ELECTRODE FACING TOWARDS THE BOUNDARY

SUB-SURFACE FORMATION BOUNDARY DETECTION USING AN ELECTRIC-FIELD BOREHOLE TELEMETRY APPARATUS

This application is a continuation-in-part of pending U.S. Ser. No. 11/584,778, filed Oct. 23, 2006.

BACKGROUND OF THE INVENTION

This invention relates generally to sub-surface formation boundary detection and more specifically to method and apparatus for such detection using borehole telemetry apparatus.

It is known that shale in natural formations may contain significant amounts of hydrocarbon. It is further well known that significant amounts of hydrocarbon can be recovered by boring holes into the formation and using so-called fracking techniques. Such beds may extend generally horizontally, and be relatively thin in vertical extent. U.S. Pat. Nos. 6,280,000 and 6,425,448 describe examples of such drilling and show particular patterns of holes to drain methane from a coal formation. In the boring of such holes, method and means are needed to steer the drilling progress, so as to remain in the bed and, to the extent possible, bore a straight hole such that up and down variations in the borehole path are minimized.

Conventional or current boring, or drilling, operations use some sort of measure-while-drilling (MWD) apparatus. Such an apparatus generally includes inclination and direction sensors, various logging sensors to assist in determining that the borehole trajectory remains in the underground formation and a communication means to transmit data to the surface so that the necessary control operations to control the drill string path can be performed. Typical inclination sensors include accelerometers to sense the earth's gravity field. The most commonly used direction sensors are magnetometers to sense the earth's magnetic field although gyroscopic sensors may be used in some circumstances. Logging sensors may include conventional resistivity sensors based in the low-megahertz frequency range, total gamma ray sensors and focused gamma ray sensors. In current practice, the only sensors that can provide reliable information as to whether or not the drilling apparatus is within or out of the selected formations are the various gamma ray sensors. Theses sensors generally have a very short range, perhaps only a few inches, and thus the drill bit may already be out of the selected formation by the time that gamma ray sensors provide an indication of such a condition. Given this limitation, such boreholes may have considerable variation in inclination as the path of the drill bit is steered. Further, conventional resistivity tools would increase the length of the bottom hole assembly at the bottom of the drill string and would increase the cost of drilling. While certain resistivity apparatus and methods are used to steer the drilling apparatus in order to maintain the borehole in a desired geological bed, none of these is similar to or has the advantages of the present invention described below.

There is a need for improved sensing method and means that can efficiently detect the boundary of the selected formation, such as shale formation, at a considerably greater depth of investigation around the borehole and most desirably one that can provide some indication of the conditions out ahead of the bit so as to permit correction of the drill path with reduced variation in inclination.

In the measure-while drilling (MWD) process for drilling, the borehole telemetry technique of choice is the electric field technique that involves direct injection of electric current into the surrounding formation at a point below an insulating gap in the generally conducting steel drill string. This injected current flows out into the formation and develops a detectable electric voltage between a remote contact to the earth and the drill string at the surface of the earth. Examples of such apparatus are disclosed in U.S. Pat. Nos. 5,130,706, 5,883,516, 6,188,223 and 6,396,276. It has been observed experimentally, and confirmed analytically, that when the drill bit is employed in a coal seam the apparent driving-point impedance, defined as the ratio of the output voltage to the output current, seen at the output stage of an electric field borehole telemetry apparatus decreases as the drill bit below an insulating gap approaches a coal seam boundary and penetrates into an adjacent rock layer. Further, it has been observed experimentally and confirmed analytically that the received signal strength at the surface of the earth increases for the same approach to and penetration into an adjacent rock layer.

SUMMARY OF THE INVENTION

It is a major objective of this invention to provide an improved method to detect a sub-surface formation boundary or boundaries, using an electric field borehole telemetry apparatus. This is useful for example to facilitate subsequent fracking and fracking locating procedure in shale. This method enables use of the telemetry apparatus to transmit inclination, direction and logging parameters to the surface for use in steering the drill string to remain in the formation, i.e. relative to the formation boundary, and particularly both up and down boundaries, in a way that substantially benefits results in terms of better control of the borehole trajectory at a lower cost. The invention also provides a method for assisting in steering a drill bit so as to maintain the drill bit in a sub-surface bed or seam, during drilling, enabling the borehole to be used for reception of fracking equipment. The method of the invention includes detecting the relative position of the drill bit with respect to a formation boundary or boundaries, using an electric-field borehole telemetry apparatus.

Another object is to provide a method of maintaining drill bit advancement in an underground in situ formation, that includes a) passing an electrical signal from a location in the vicinity of the bit to a location in the underground formation, above the level of the bit, b) detecting substantial change in that signal as the bit advances, c) and changing the direction of drilling of the bit as a function of said signal change, to thereby maintain or control the direction of bit advancement in the formation or seam.

In this regard, the electrical signal is typically electrical current passed from the seam through a seam boundary into the adjacent underground formation.

More detailed steps of the method include:

1. providing a measure-while-drilling apparatus that includes inclination sensors, directional sensors, logging sensors of choice and an electric-field telemetry borehole telemetry apparatus, 2. within the electric-field telemetry borehole telemetry apparatus, in addition to monitoring the inclination, direction and logging parameters, monitoring parameters of the electrical output of the telemetry apparatus such as pulse voltages, pulse currents and/or pulse power, 3. transmitting to the earth's surface the inclination, direction and logging parameters as well as the parameters of the electrical output by means of the telemetry apparatus, 4. detecting at the surface the data transmitted, and monitoring the signal strength received at the surface, 5. computing the usual drilling parameters needed to guide the drill string along the intended path, 6. determining from the transmitted parameters of the electrical output from the downhole apparatus and the signal strength received at the surface, parameters indicative of drill bit approaching or penetrating a formation boundary, and 7. making corrections to the direction of drilling to maintain the drill string and bit in the selected seam.

A further object is to provide a method of production of hydrocarbon from a selected underground formation, and utilizing an underground coal seam in proximity to the selected formation, that includes a) drilling in the coal seam having a boundary facing the selected formation, b) drilling through the boundary, and into the selected formation and to a preferred location therein, c) producing hydrocarbon fluid from said location, for recovery at the surface.

Added objects include fracking the selected formation at said location to enhance hydrocarbon recovery; and wherein producing includes flowing hydrocarbon fluid from said location through a borehole formed by drilling.

Yet another object includes providing a method of determining an optimum location in a selected formation, for fracking procedure.

A further object includes use of the method as described to determine the location of formation boundaries above and below the zone in which drilling is being effected.

The present invention also allows determining the direction and/or distance of sub-surface bed boundaries during drilling, by using short hop telemetry signals. The distance and direction of the bed boundary as determined by the system then can be used to control the direction or inclination at which the well is drilled.

In the disclosed and preferred embodiment the LWD tool includes a transmitter/receiver pair for sending short hop telemetry signals into the formations surrounding the wellbore and receiving these signals as at well head. This transmitter/receiver pair is provided on an upper and lower end of the drill-string for communicating information between a sensor located near a drilling bit and the system axially along and behind the drilling motor. One of the antennas is off center with respect to the drill string i.e. is not symmetric with respect to the drill string. The preferred antenna leads to a variation in signal strength of the short hop signal depending on its orientation.

The signals detected by the receiver are processed with the respective information of the antenna orientation at the time of their transmission. The variation in signal strength with rotation is used to determine the direction of the adjacent bed boundary. The signal strength for a fixed orientation, or the average of the signal strength covering 360° orientation (antenna facing towards and away from the boundary) can be used to calculate or estimate the distance to the bed boundary.

These and other objects and advantages of the invention, as well as the details of an illustrative embodiment, will be more fully understood from the following specification and drawings, in which:

DRAWING DESCRIPTION

FIG. 1 shows a typical drilling process including a drill string, an insulating gap near the bit and various layers of formation material in the region of a selected seam; FIG. 1 also being representative of drilling in a coal seam;

FIG. 2*a* shows a computer simulation of the output current of the electric-field telemetry apparatus when the drill bit and drill string are in the selected seam and not in contact with other layers of the formation;

FIG. 2*b* shows a computer simulation of the output current of the electric-field telemetry apparatus when the drill bit is in contact with another layer of the formation above the seam;

DETAILED DESCRIPTION

Figure 1:
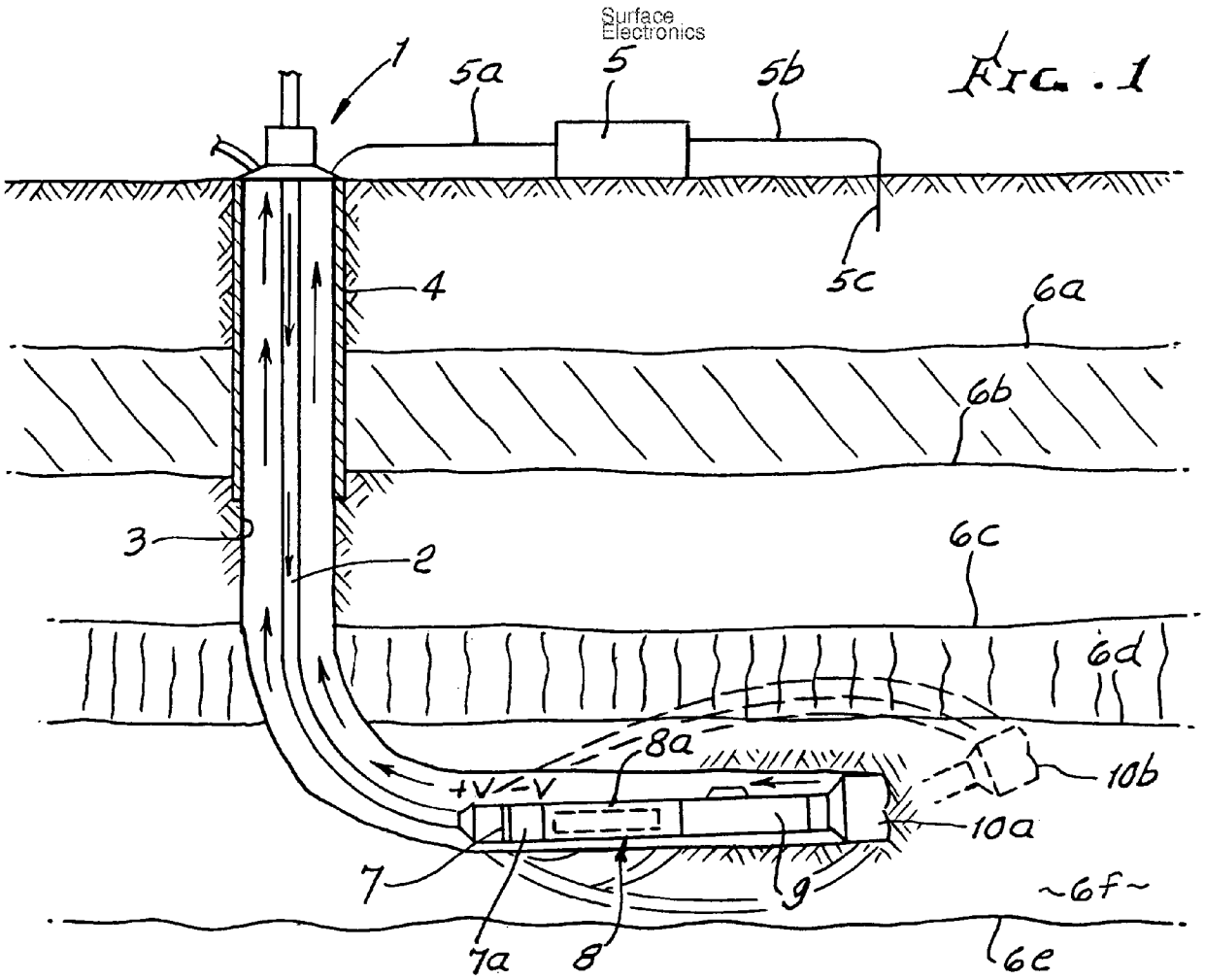

FIG. 1 shows a typical drilling process including a drill string, an insulating gap in the string near the bit, and various layers of underground material in the region of a selected seam or formation layer. A drill rig 1 at the surface of the earth is connected to a drill string 2 penetrating down into the earth. The upper portion of the borehole is shown with casing 4, and the open hole 3 continues below the casing. An insulating gap 7 in the string is at or proximate the lower end of the drill string. Below the insulating gap a non-magnetic collar 8 in the string contains a measure-while-drilling (MWD) apparatus indicated at 8*a*. A mud motor 9, below 8, is or may be used to rotatably operate a rotary drill bit 10*a*. A future projection of the location of the drill bit indicated at 10*b* shows where the drill bit is projected to be at some future time. At the surface, an electronics assembly 5 is shown electrically connected to the upper end of the drill string, as by connection 5*a*. Connection 5*b* provides an electrical connection from a remote contact 5*c* with the earth to the electronics assembly 5. Information is communicated from the measure-while-drilling apparatus to the electronics assembly 5 by applying output voltage or current signals across the insulating gap 7, as by means 7*a* (see plus and minus voltage zones +v and −v. Current then flows from the lower region below the insulating gap 7 through the earth to the surface. This current then causes a voltage difference between the upper end of the drill string connected to lead 5*a* and the remote connection to the earth connected to lead 5*b*. The drill string between the insulating gap 7 and the upper end of the drill string connected to lead 5*a* is generally of steel and therefore has much greater conductivity than the path through the earth.

The earth formation going downward from the surface is indicated typically by layer boundaries 6*a*, 6*b*, 6*c*, 6*d* and 6*e*. These boundaries will, in general, represent different kinds of rock, and the region between the boundaries 6*d* and 6*e* are the upper and lower boundaries of a shale seam or layer 6*f* that is to be drilled. The location of this seam is generally known as by prior work before drilling is begun. By well-known techniques, such as using a mud motor and a bent sub in the string above the bit, the borehole 3 is drilled downward from the surface and then caused to turn toward a horizontal condition as shown when the depth of the shale seam is reached. That may be nominally horizontal, but there may be a known or approximately known small inclination angle to the seam. The object of the drilling process is to drill for an extended distance while maintaining such drilling within the shale seam to provide a path for enhancement of fracking equipment, and/or the recovery of hydrocarbon such as oil or gas from the selected seam. Previously, little information was available to assist in maintaining the drill bit path within the seam, as during horizontal drilling, to different locations within the seam. Gamma ray detectors, either total gamma ray counters or so-called focused gamma ray counters, were frequently used for detecting an out-of-coal seam drilling condition. Such detectors provide very short depth of investigation and are located a considerable distance behind the bit so that the resulting borehole path tended to have considerable up and down bending deviation since the bit had to be out, or nearly out, of the bed or formation layer before deviation from the desired trajectory was sensed, and only then could a correction in drilling direction be made, using known measure-while-drilling techniques to change the inclination of the borehole to return to the desired trajectory.

During employment or use of an electric field borehole telemetry apparatus, and a part of the measure-while-drilling apparatus, that included monitoring and transmitting the value of the output current along with the other data, it was observed when drilling in a coal seam that when the bit was approaching or deviating out of the coal seam, the output current increased. It was further noted that under such conditions, the signal level received at 5 at the surface between connections 5*a* and 5*b* increased. It was also observed that the resistivity of the coal in the coal seam was significantly higher than the resistivity in the adjacent rock layers such resistivity affecting the output current. Typical resistivity for a coal seam may be on the order of 100 ohms-meter while that of adjacent rock layers such as shale may be on the order of 4 ohm-meters.

Figure 2A:
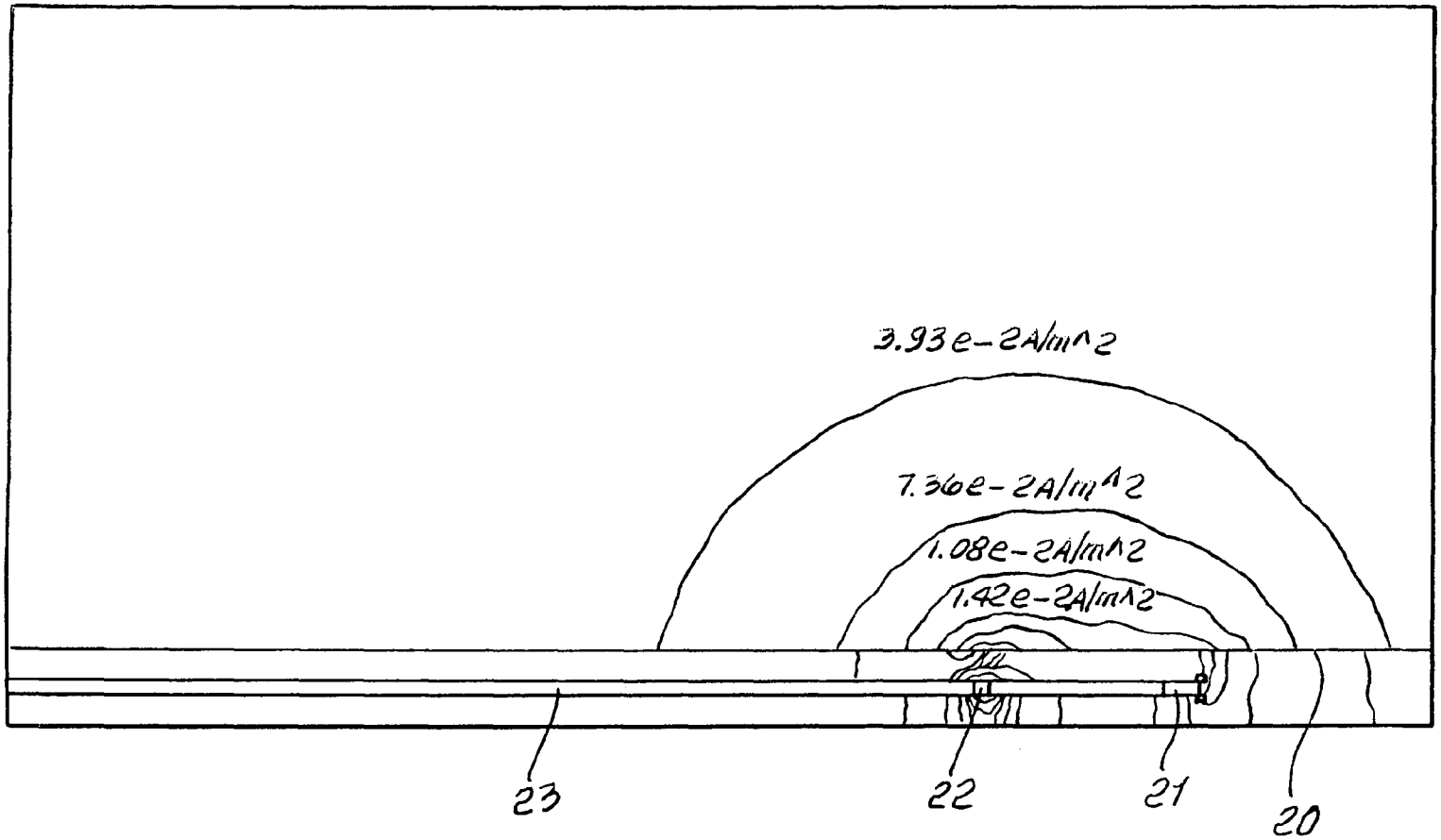

FIG. 2*a* shows a computer simulation of the output current of the electric-field telemetry apparatus when the drill bit and drill string below gap 7 are in a coal seam and not in contact with or penetrating into other layers of the formation. This can be represented by using an electrical finite element model. The region of the formation above the upper boundary 20 of the coal has a resistivity of 4 ohm-meter. The region in the coal below the coal boundary 20 has a resistivity of 100 ohm-meter. The contour lines in the diagram are such that they show electric current density. The current density contours are labeled in terms of amperes per square meter (A/m^2).

An insulating gap 22 is provided between the portion of the drill string 23 above (i.e. to the left of) the insulating gap and that portion of the drill string, including the drill bit, 21 below (i.e. to the right of) the insulating gap 22. Neither the drill bit nor any portion of the drill string as referred to is in contact with the low-resistivity material above the coal boundary 20. The contour lines going from $1.42e^{-2}$ A/m^2 near the drill string section 21 to $3.93e^{-2}$ A/m^2 at longer distances from 21 are indicative of low current density resulting from the high resistivity of the coal between the drill string and the layer above the boundary 20.

Figure 2B:
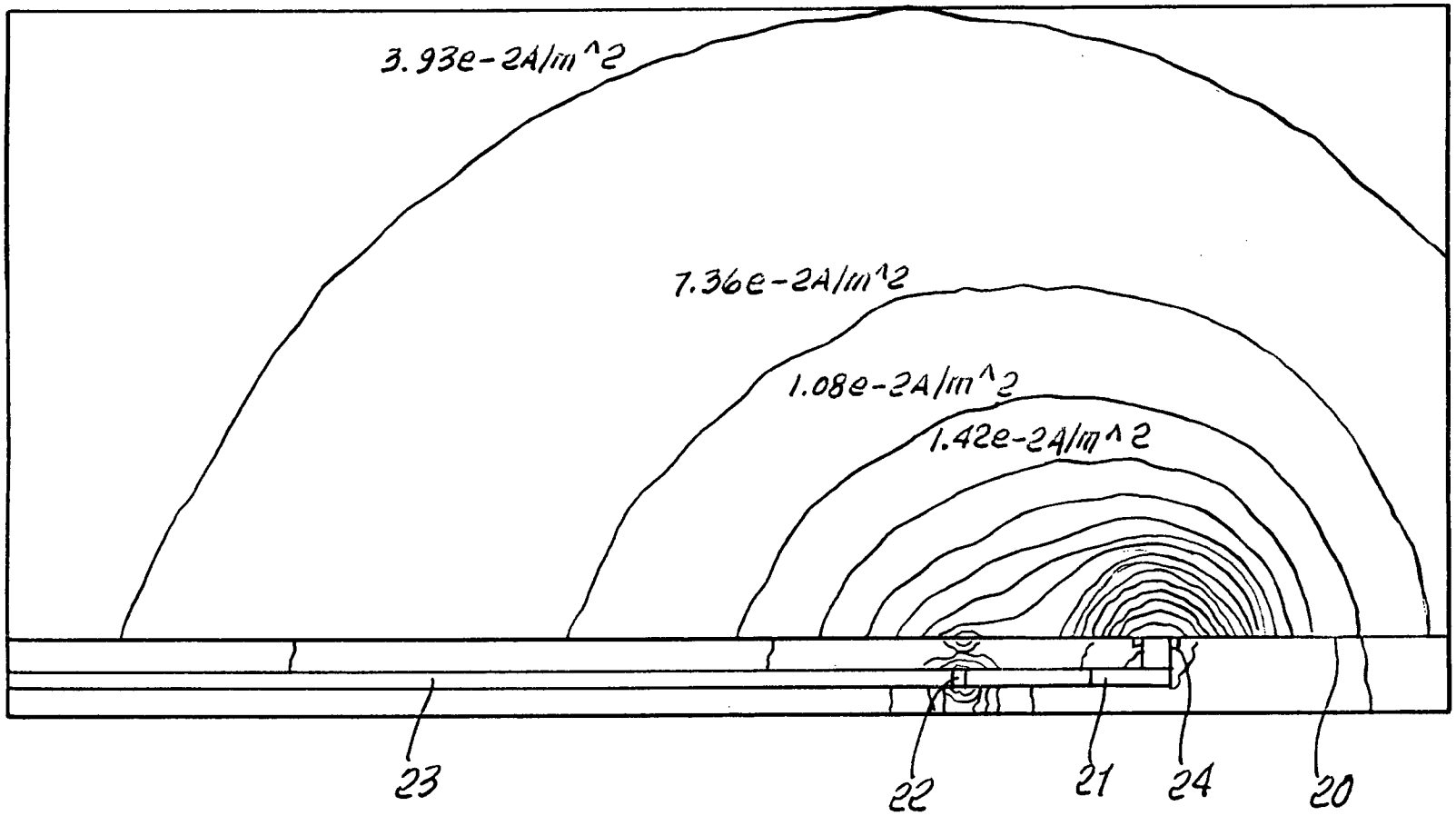

FIG. 2*b* shows a computer simulation of the output current of the electric-field telemetry apparatus when the drill bit is in contact with another layer of the formation. The same electrical finite element model was used as for FIG. 2*a*. The resistivities of the layers are the same as for FIG. 2*a*. In FIG. 2*b* the drill bit 24 is just in contact with the layer above the edge of the coal 20. From the much greater distances to the corresponding current density contours of FIG. 2*a*, in this figure above the seam edge 20, it is apparent that the current density is much larger in this region than it was for the case of FIG. 2*a* where there was no contact. The driving voltage applied between the drill string sections 21 and 23, across the insulating gap 22, was the same for both computations. The region above the coal boundary and extending to the surface can be considered as an impedance network. Since the current flowing into the network is increased, the so-called driving point impedance seen by the power-output device in the electric-field borehole telemetry apparatus is decreased for FIG. 2*b* in comparison to FIG. 2*a*. Driving point impedance for a network is defined as the applied voltage divided by the input current. Such a driving point impedance is generally abbreviated as $Z_D$. This confirms the experimental observation that the driving point impedance seen by the telemetry apparatus decreased when the bit was known to be approaching or out of the coal seam. Further, since the current flowing into the layers above the bit is increased for the conditions of FIG. 2*b* the voltage received at the surface between the leads identified as 5*a* and 5*b* in FIG. 1 will be increased. The value of $Z_D$ can be determined from measurements transmitted from the downhole location to the surface and the voltage received at the surface can be measured. Thus there are two measures available from the telemetry apparatus that provide useful information on the positional relation of the drill bit and the boundary of the coal seam. In other drilling situations, not related to coal bed methane recovery, changes in the voltage received at the surface using an electric-field borehole telemetry apparatus have been noted and believed to be related to formation resistivity.

Figure 3:
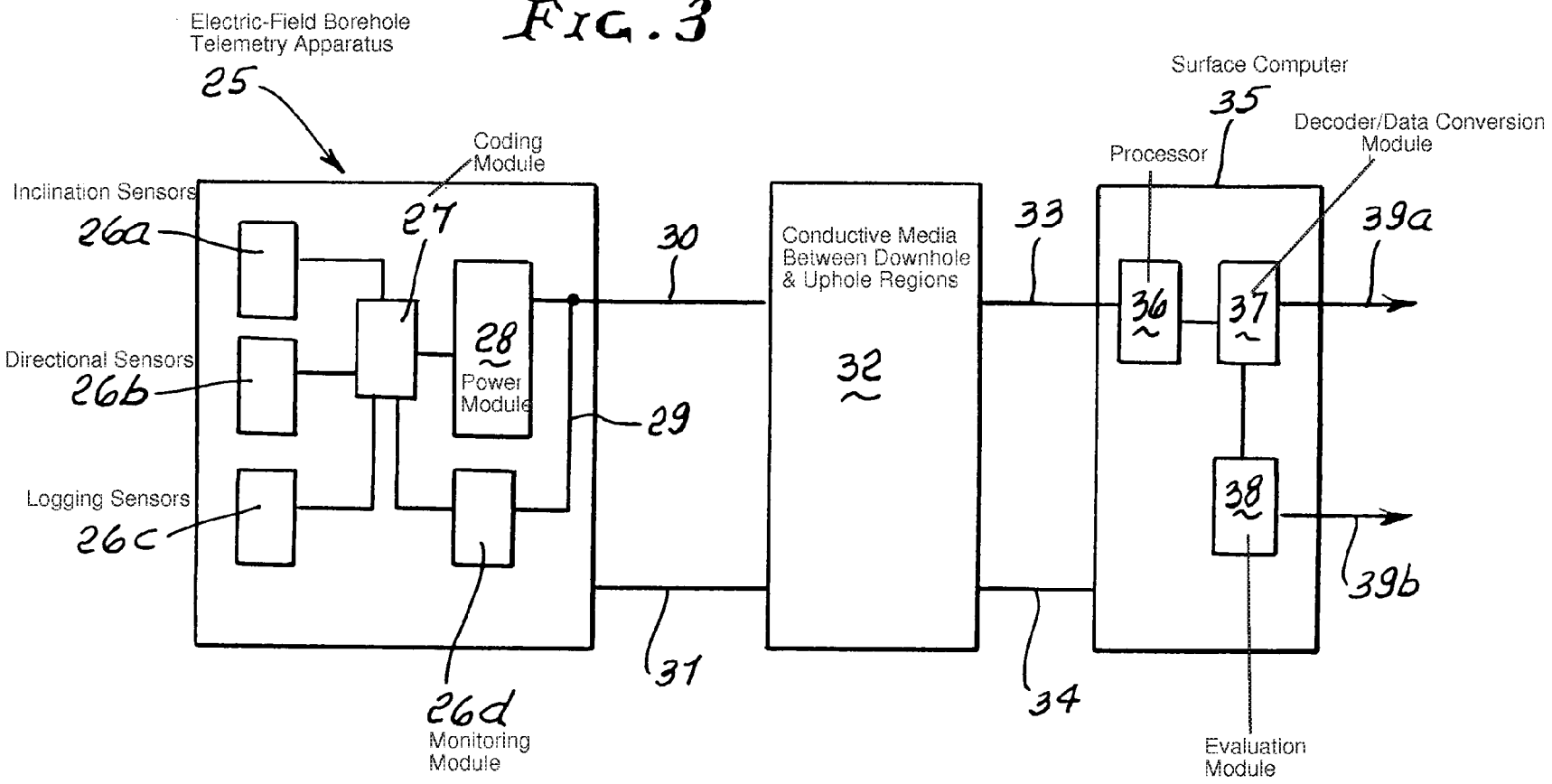
FIG. 3 is a block diagram showing the borehole telemetry apparatus, the conductive media between the downhole and up-hole regions and the receiving and processing apparatus at the surface.

FIG. 3 shows a block diagram representative of the borehole telemetry apparatus, the conductive media between the downhole and up-hole regions and the receiving and processing apparatus at the surface. An electric field borehole telemetry apparatus 25 comprises inclination sensors 26*a*, direction sensors 26*b*, and logging sensors 26*c* connected to a signal conditioning, multiplexing and coding section 27. The output of the coding section 27 is applied to a power section 28 that is connected to the output line 30 which is connected to the drill bit below the insulating gap 7 of FIG. 1. The power section 28 may be of a constant voltage, constant current or other type. Connection 29 transmits information, for example voltage and/or output current, from the outputs line 30 to monitoring elements 26*d*. The output of the monitoring elements 26*d* is connected to the coding section 27 so the results of such monitoring are added into the data stream that is transmitted to the surface. Output line 31 is a current return path and represents elements of the conductive drill string above insulating gap 7 of FIG. 1.

The block 32 represents the conductive media between the downhole and up-hole regions. As shown it is a typical four-terminal electric network. The terminal connected to lead 31 is the point on the drill string just above the insulating gap 7 of FIG. 1 and the terminal connected to lead 34 is the point at the top of the drill string connected to lead 5*a* of FIG. 1. If the resistivity of the drill string between the insulating gap and the surface is insignificant compared to all other resistivities, the points of connections 31 and 34 may be considered common and the network reduces to a three-terminal network. The lead 33 is equivalent to lead 5*b* of FIG. 1 and represents the connection from a remote contact with the surface of the earth and the receiving and processing apparatus at the surface 35. The receiving and processing apparatus 36 provides amplification, de-multiplexing and decoding of the received signal to recover the data transmitted from the downhole location and a measure of the amplitude of the received signal. The block 37 provides any further decoding and data conversion required and provides inclination, direction and logging outputs on lead 39*a* to operators to assist in judging the path of the borehole and planning any needed corrective actions, as for bit steering. Downhole electrical output information, for example voltage and/or output current, as well as a measure of the amplitude of the received signal are transmitted to block 38 as parameters indicative of approaching or penetrating the coal boundary for evaluation of the relationship of the borehole location to the desired in-coal location. Information from this evaluation is transmitted to operators on lead 39*b* for planning any required actions to remain in the coal seam.

Some electric-field borehole telemetry apparatus may include a capability to transmit command information downward from the surface to the downhole telemetry apparatus. When such a capability is present and evaluation parameters indicate a possible approach to the coal seam boundary a command may be sent downward from the surface directing the downhole apparatus to increase its output signal power. This may be done by increasing the voltage, current or time duration of the signals being transmitted upward. With such an increase in the transmitted signal uncertainties such as downhole movements, rig noise and surface interference are minimized, thus in effect increasing the signal-to-noise ratio of the boundary detection process.

Note that the only apparatus that needs to be added to the electric-field borehole telemetry apparatus as shown in FIG. 3 to permit the use of the method of this invention includes the block 26*d*, the monitoring elements, and block 38, the block that provides the evaluation of the relationship of the borehole location to the desired in-coal location.

Figure 4:
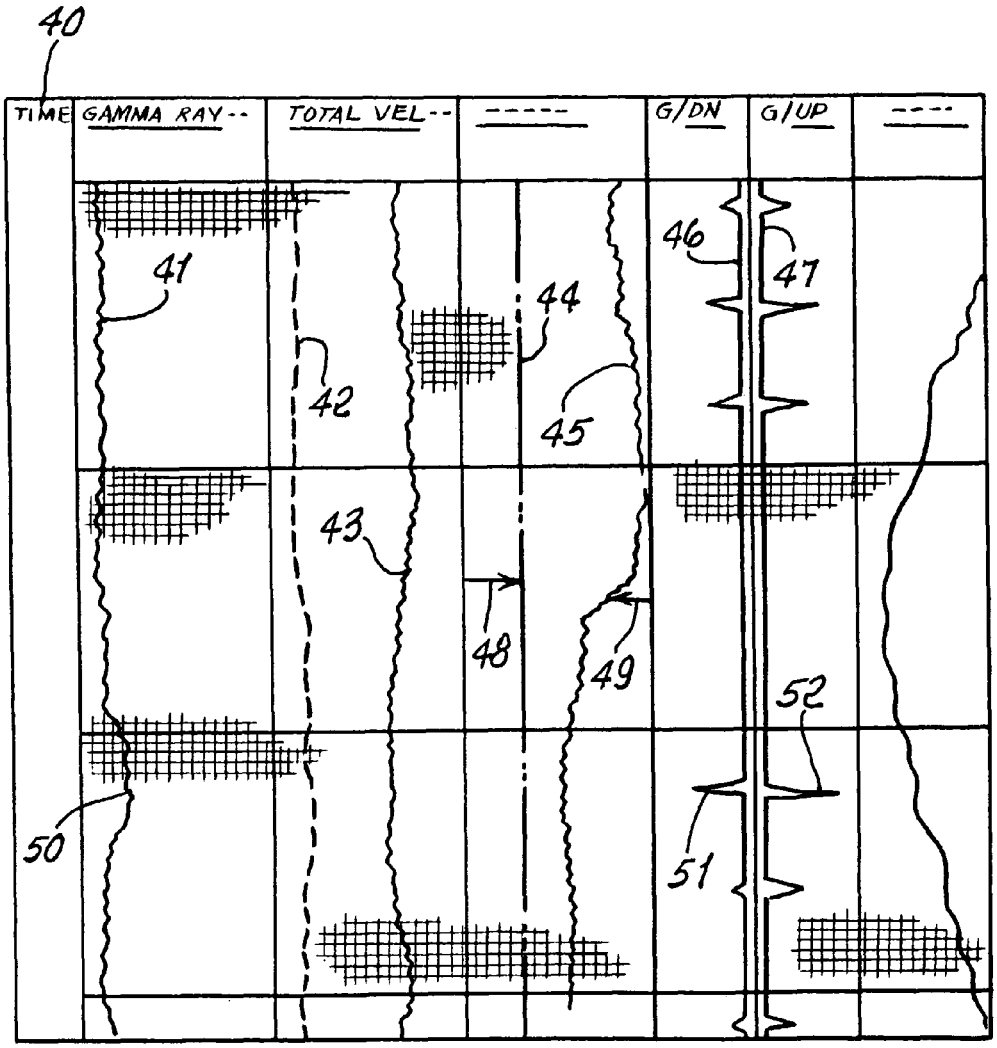
FIG. 4 shows a representative detail log plot from a drilling operation in a coal seam and shows the transmission-parameter variations that are indicative of approaching or penetrating a coal stem boundary.

FIG. 4 shows a detail log plot from an actual drilling operation in a coal seam, and indicates the transmission-parameter variations that are indicative of approaching or penetrating the coal boundary. A date/time scale 40 is shown at the left of the figure. The major divisions on this scale are one hour, the next level of scale is ten minutes and the finest scale is for two-minute time increments. A trace 41 for the output of a gamma ray detector, a trace 42 for the tool output current, a trace 43 for the tool output voltage, a trace 44 for the received signal at the surface of the earth, a trace 45 for the driving point impedance, $Z_D$, (defined as the ratio of the tool output voltage to the tool output current), and two traces 46 and 47 for a focused gamma ray measurement are provided. Trace 46 is for gamma ray data received from the down direction and trace 47 if for gamma ray data received from the up direction. Other traces are shown for ROP, rate of penetration, TVD, total vertical depth and Bit Depth but these are not used in the discussion below. Note that near point 48 an increase in Pulse Voltage, the received signal at the surface, shown on trace 44 is seen. Further, near point 49 a decrease in the driving point impedance shown on trace 45 is seen. These changes are indicative that the tool bit is approaching the boundary between the coal seam and the adjacent lower-resistivity rock layer. Drilling proceeded for about twenty minutes before an increase in the gamma ray measurement shown on trace 41 is observed. This increase that becomes a maximum near the point 50 in the total gamma ray measurement and indicates that the drilling apparatus is proceeding or deviating out of the coal seam. Further, the focused gamma ray signals, shown on traces 46 and 47 confirm that the tool is out of the coal as shown by points 51 and 52. Since the amplitude of the gamma-up signal 52 is greater than the gamma-down signal 51, it is apparent that the tool has gone out of the coal seam at the top of the seam. Corrective action was taken and the tool descended back into the coal, restoring the indicated signal to levels comparable to those seen before the detection of indications that the drill trajectory was going toward an out-of-coal condition.

The significant issue that the indications from trace 44, the surface received signal, and trace 45, the driving point impedance, showed the existence of the problem about 20 minutes prior to actually going out of the coal. Corrective action based on these indications can prevent going out of the coal and this would result in a smoother borehole trajectory in the seam.

It is clear from the discussions above that the indications of approach to and going beyond (i.e. penetrating) the boundary of the coal bed are similar at both the upper and lower boundaries of the bed. Operator experience and the making of minor variations in the inclination of the borehole to observe changes in the indications provide the means to identify which case is most probable.

Figure 5:
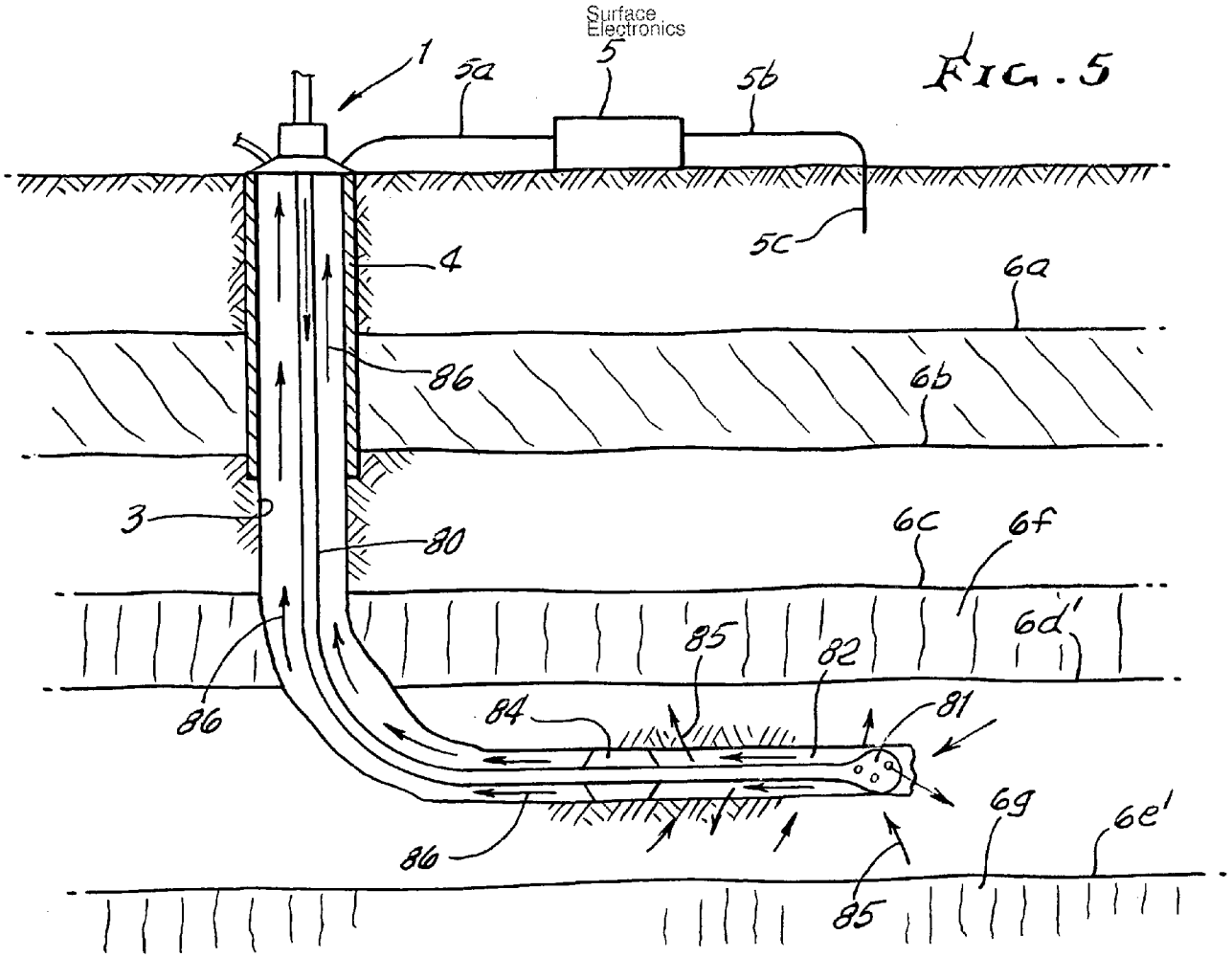
FIG. 5 is a schematic view of a drilled-into preferred location to enable hydrocarbon production after fracking.

FIG. 5 schematically shows running into hole 3, of a fracking (hydraulic fracturing) string 80 having a head 81 to which highly pressurized hydraulic fluid such as water is delivered from the well head at 1. That fluid is delivered to space 82 to pressurize and open up or fracture crevices, to enable oil or gas to leave the bed and enter the hole. A plug 84 may or may not be used or west to localized build-up of hydraulic fracking fluid. String 80 may be withdrawn after fracking, to allow pressurized oil or gas to flow back up the hole, for oil or gas production at the well head. Since accurate drilling is achieved by the invention as for example by centralizing the drilled end of the hole, between up and down boundaries at 6*d* and 6*e*, the oil or gas production flow may be maximized. See production flow arrows 85 in the formation at the locus of fracturing, and production flow arrows at 86.

Figure 6:
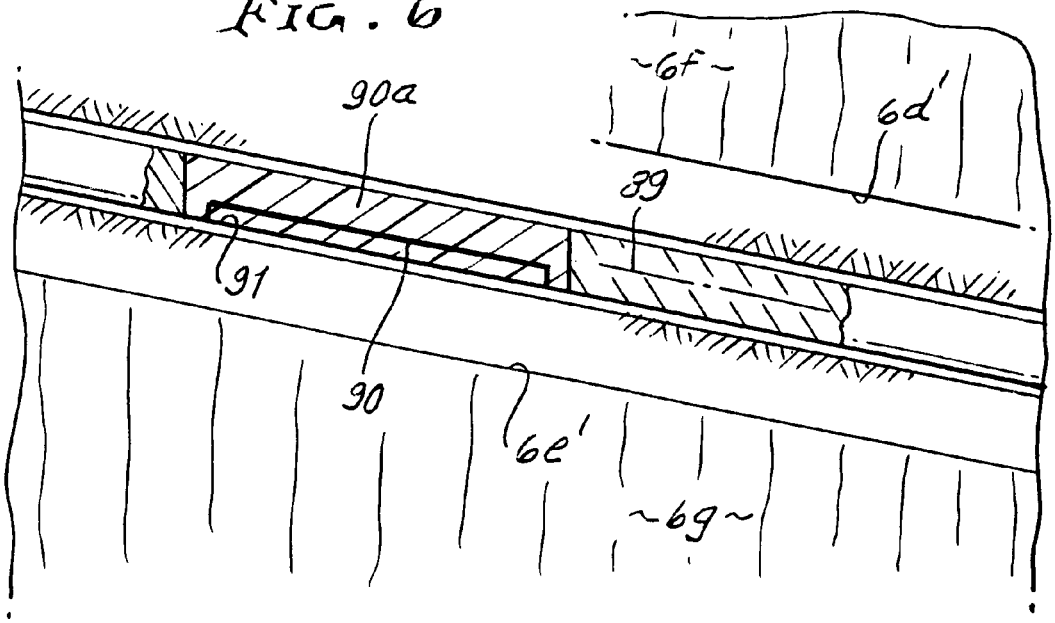
FIG. 6 is a schematic view of a metallic strip antenna, in a drill string, and offset from a string axis, for enabling upper and lower shale boundary determination.

FIG. 6 shows provision of an antenna 90 in the drill string, below the gap 7. It may take the form of a metallic strip positioned in offset relation to the string axis 89, as at the bore 91 of the string. Strip 90 may be embedded in insulation 90*a*. Thus, as the drill string is rotated as during drilling, the antenna strip 90 is rotated toward and away from the two formation boundaries 6*d*' and 6*e*', corresponding to coal boundaries 6*d* and 6*e* in FIG. 1. The received signal, or its amplitude, as referred to, varies cyclically as the string is rotated, close to the different electrical resistivities of the shale, and of the non-shale layers 6*f* and 6*g* above and between respective boundaries 6*d*' and 6*e*'. Such signal amplitude variance is detected, as indicative of the closeness of bit travel to the boundaries as the bit is rotated and advanced in the selected formation.

Figure 7:
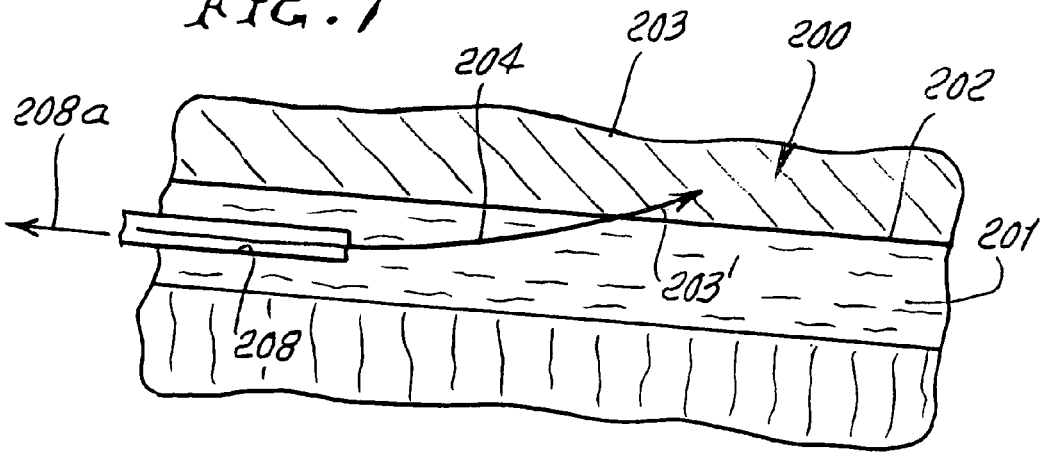
FIG. 7 is a schematic view of drilling through a boundary between a coal seam and a selected seam.

FIG. 7 shows a method of production of hydrocarbon such as oil or gas from an underground formation or layer 200. A coal seam 201 extends general parallel to and in proximity to 200, and has a boundary 202. Steps of the method include:

a) drilling at 204 in the coal seam having a boundary 202 facing the adjacent formation, b) drilling through boundary 202, and into the formation 203 and to a preferred location 203' therein, c) producing hydrocarbon fluid from the location 203', back through the borehole 208, at 208*a* for recovery at the surface.

The formation at location 203' may be subjected to fracking to enhance oil or gas production.

Figure 8:
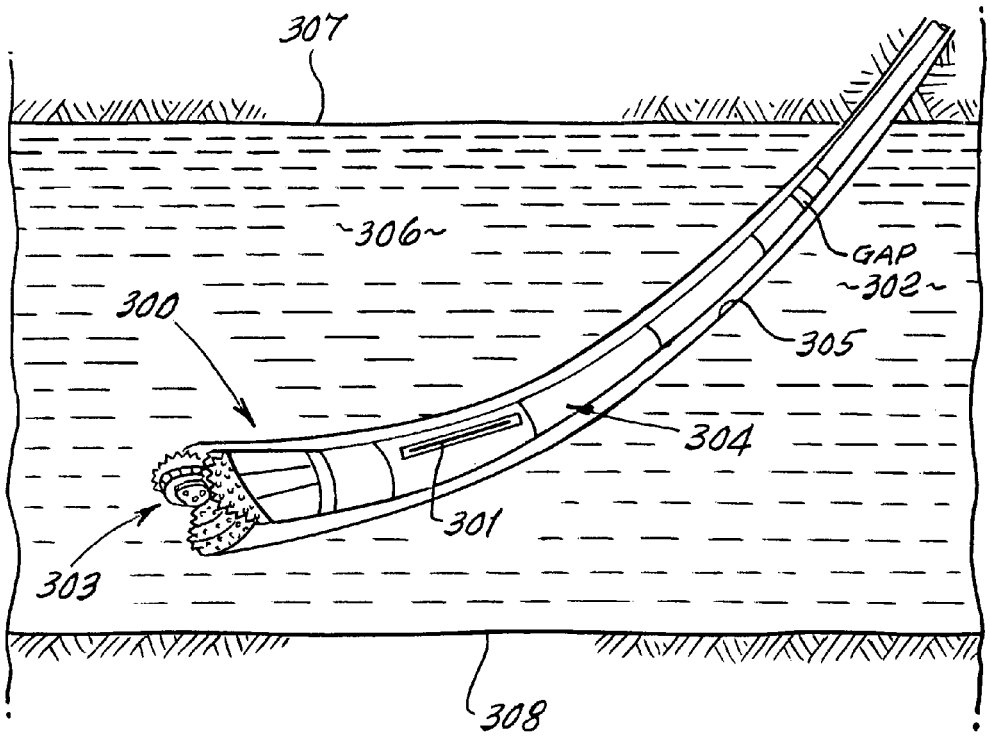
FIGS. 8-12 are schematic views.

A perspective view of a directional drill string assembly 300 with an insulated electrode 301 (lower antenna labelled 'electrode') and a gap sub 302 (upper antenna labeled 'gap') used for short hop communication is shown in FIG. 8. See also drill bit 303 at lower end of string 304, in hole 305 in an oil producing zone 306, having upper and lower boundaries 307 and 308.

Figure 9:
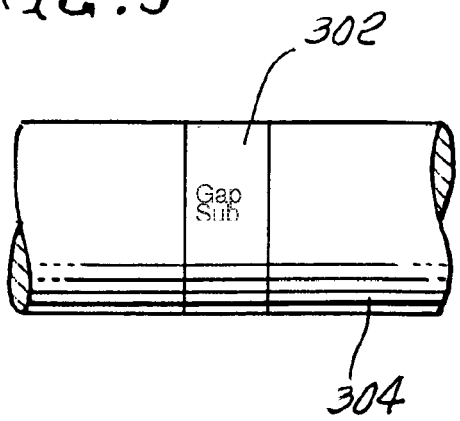
Figure 10:
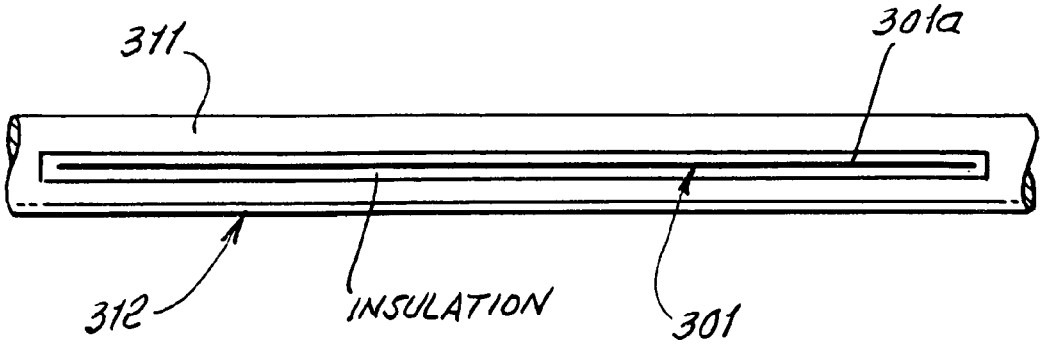

FIG. 9 shows the insulated gap 302 in the drill string 304 which is used to transmit or receive short hop data from the motor or other sensors closer to the bit. Additionally, the gap can be used to transmit information to the surface. FIG. 10 shows the insulated electrode 301 used to transmit information from an instrumented motor (Smart Motor) or other near bit device 311 and receives information from the gap. The outer edge 301*a* of the electrode facing the hole bore is shown. The electrode body, other than edge 301*a* is embedded in insulation. Information is communicated from this insulated electrode by applying output voltage or current signals across the insulated electrode and motor housing (or collar) 312. Part of the current then flows from the lower region of the drill string through the earth formation to the upper section of the drill string. This current then causes a voltage difference between the lower end of the drill string and the upper end of the drill string across the insulating gap.

Figure 11:
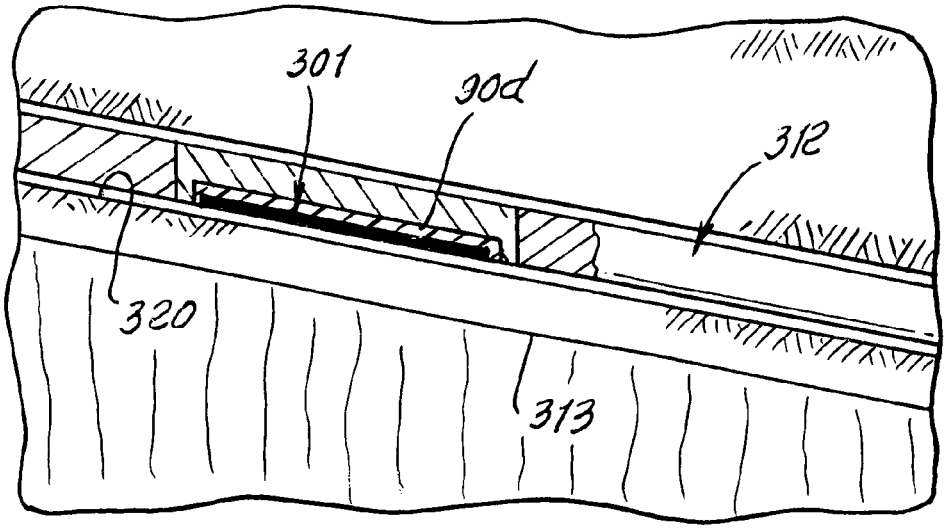
Figure 12:
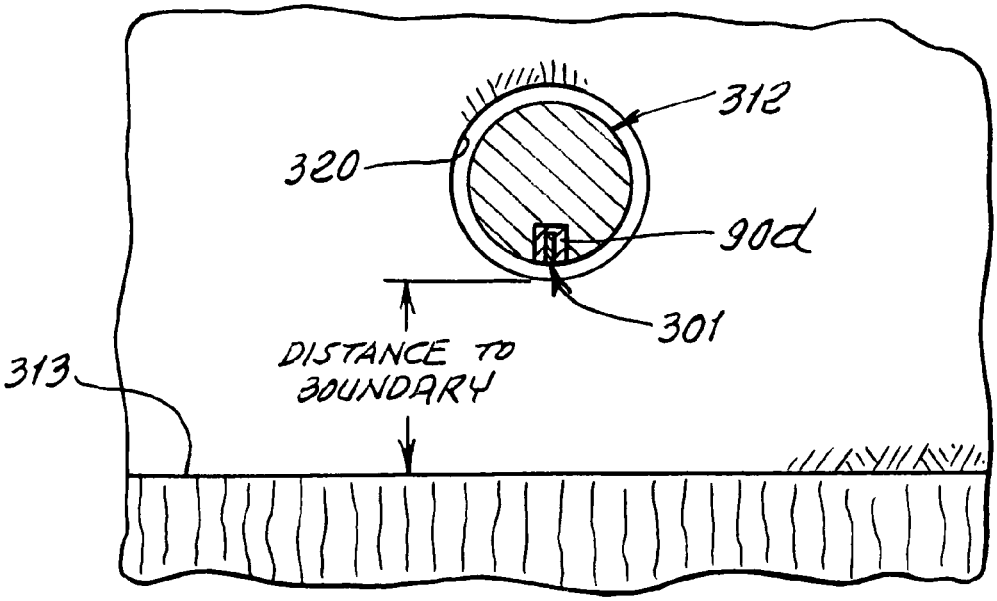

FIGS. 11 and 12 show cross sectional views of the drill string at the Smart Motor electrode and a nearby boundary 313 which is often encountered in horizontal drilling, where the object of the drilling process is to drill for an extended distance while maintaining such drilling within the desired zone (e.g. a coal or shale or other seam). The metallic electrode 301 is recessed of partially recessed into the outer wall of the drill string, so that the outermost surface of the electrode is exposed to the bore hole 320. The remainder of the electrode is embedded in insulation 90*d*. During the drilling process and during the rotation of the drill string, the electrode will be alternately facing the formation boundary or be looking away from the boundary. A signal strength variation will be seen at the gap if the resistivity contrast between the target bed or zone of drilling and the shoulder bed adjacent the target bed is high enough. This signal variation can be used to infer a proximity to a boundary. See also FIG. 13.

Figure 14:
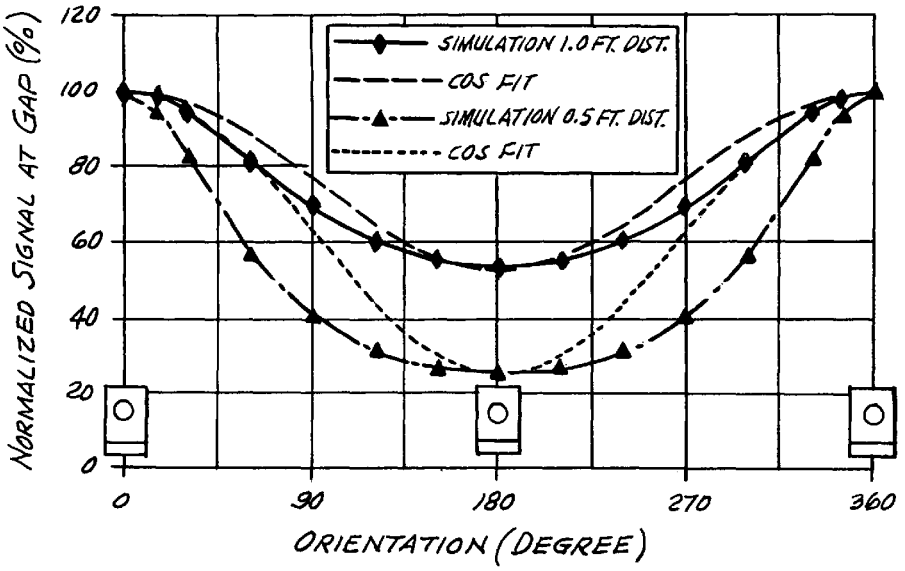
Figure 15:
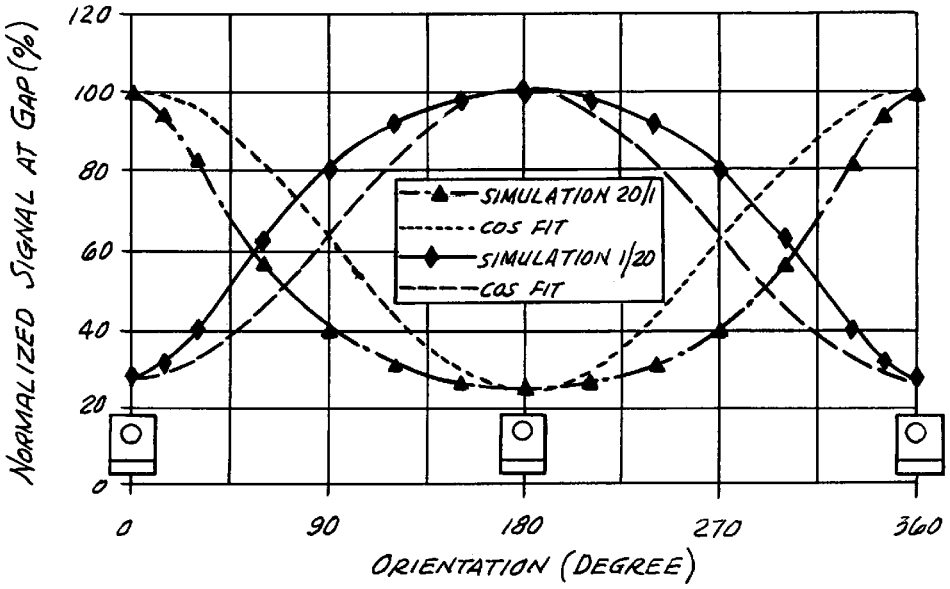

During employment of a short hop telemetry apparatus, it is expected that the signal strength will vary in an oscillatory way during string rotating. FIGS. 14 and 15 show these variations as a function of angular position for different cases. It is clear from those plots that it is possible to determine the relative position of the boundary in addition to the fact that there is a boundary due to the shape of the waveform and maximum amplitude variation changing with respect to distance from the boundary. The fact that the insulated electrode antenna is sitting on one side of the string and is therefore lacking the rotational symmetry of an electrical antenna such as a ring or gap type antenna, is the cause for this effect. Given that the resistivities of the formations is known the signal strength or strength variations is useful to determine a distance to the boundary (see FIGS. 16 and 17).

Figure 13:
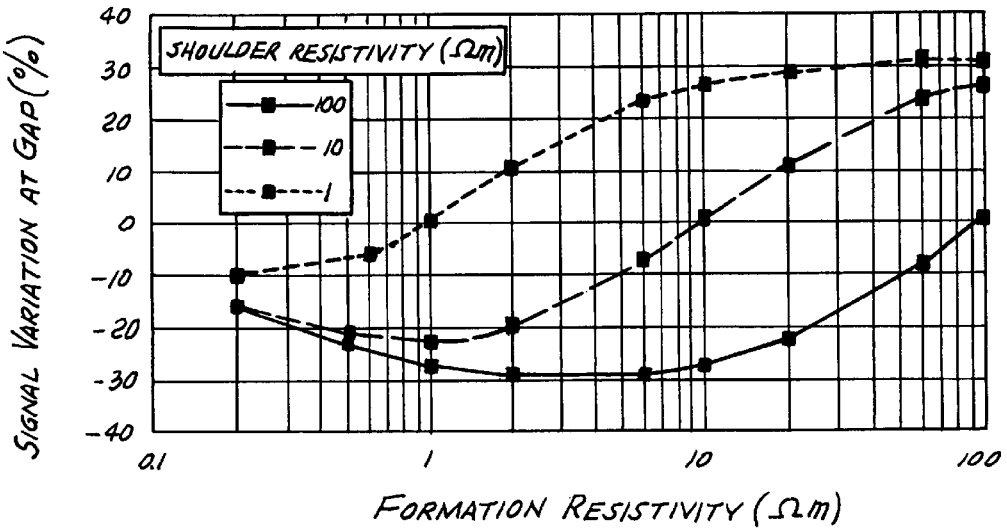
FIGS. 13-17 are graphs.
Figure 18:
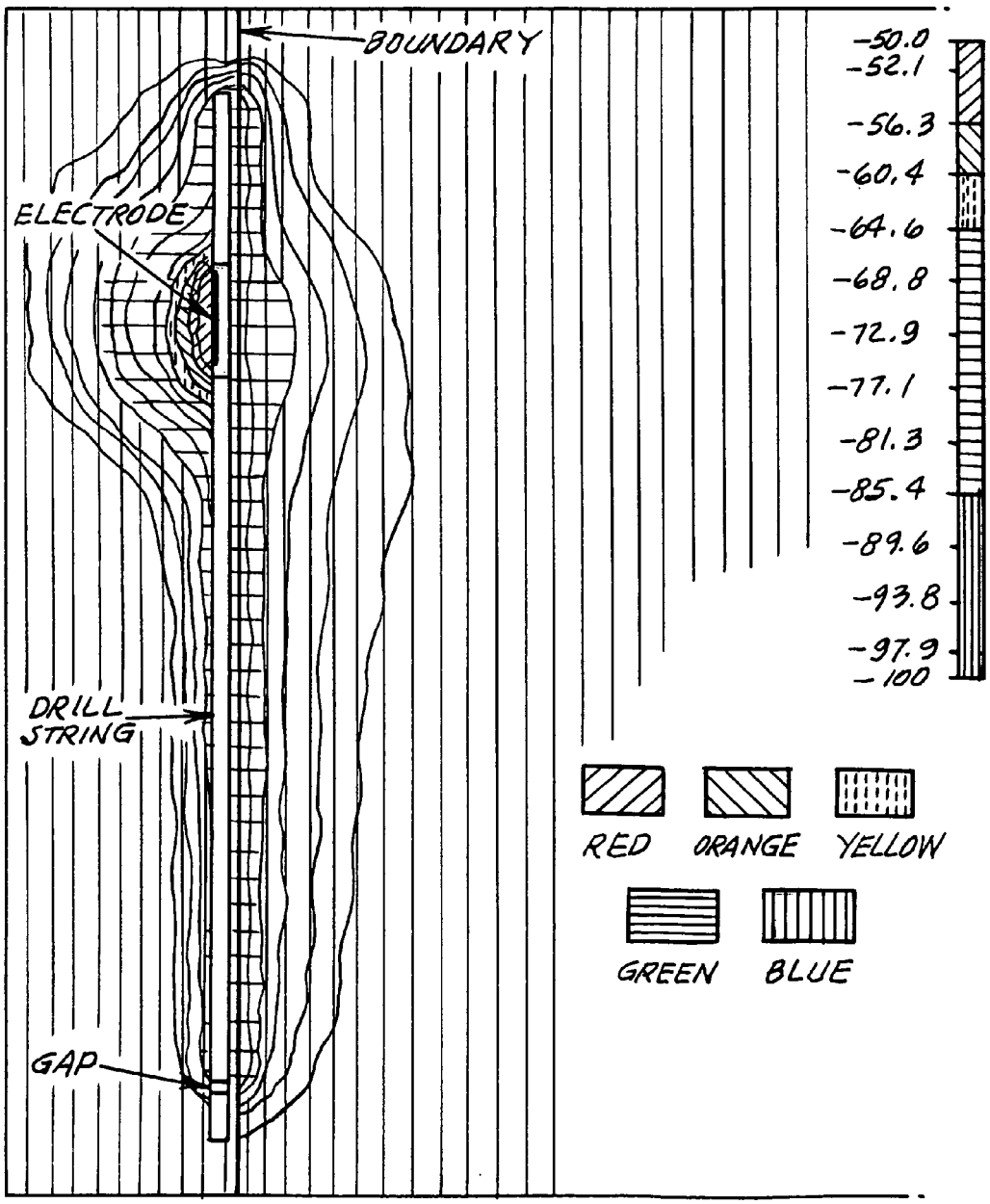
FIGS. 18-21 are current density plots.
Figure 19:
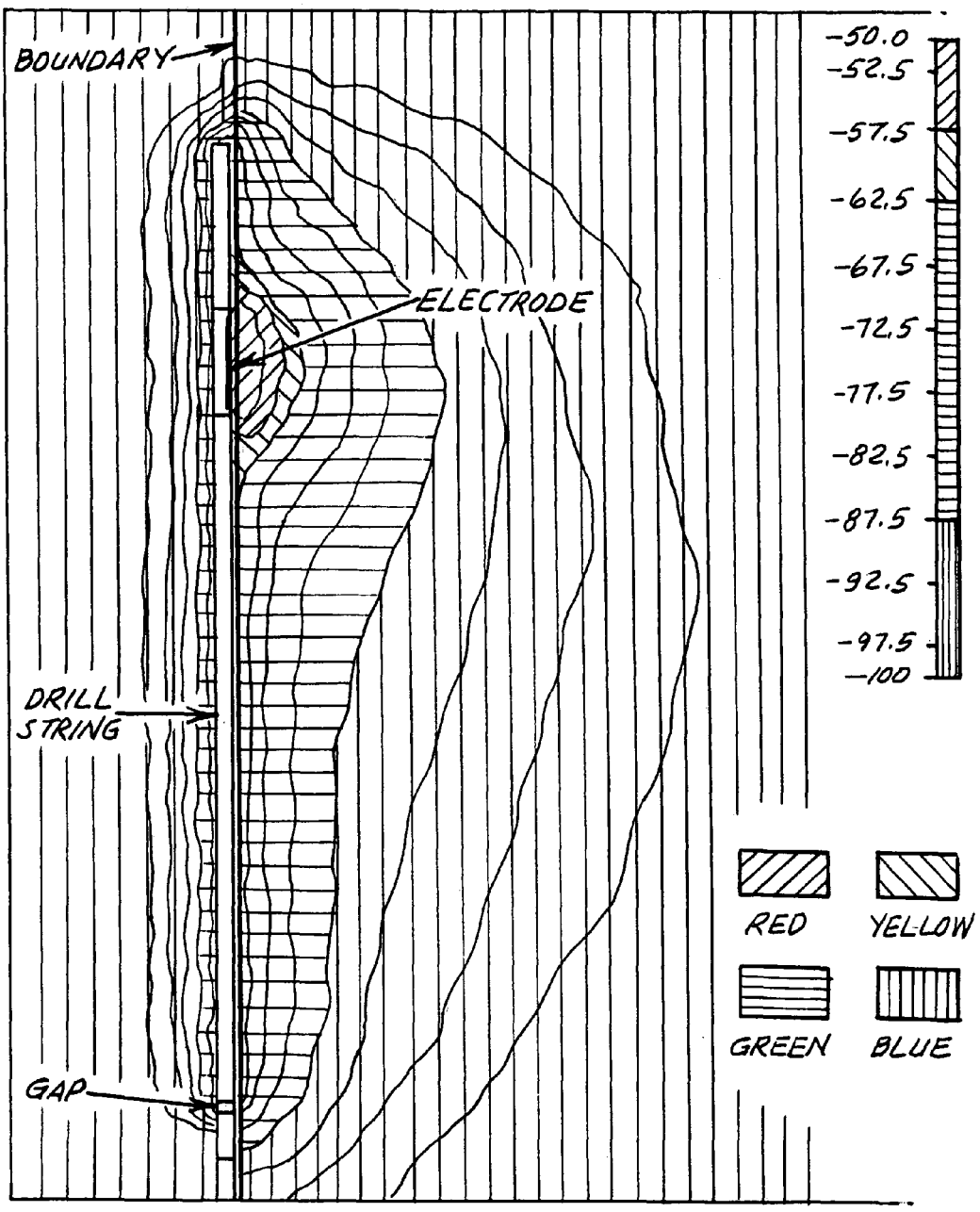

FIGS. 18 and 19 illustrate the difference in signal strength at the gap when the insulated electrode is either facing away or towards the boundary. Note the higher current densities at the gap for the case where the insulated electrode is facing the boundary (i.e. closer to the boundary) in FIG. 19. When the shoulder bed has a lower resistivity, the currents are drawn more into this shoulder bed (see. FIGS. 13 and 14) especially if the electrode is facing towards the boundary as in FIG. 14. This results in a higher signal strength received at the gap.

The invention is typically used as a means or method to detect an approaching (relative to bit advancement) boundary between zones of different resistivity, such as a coal bed, shale bed or an oil-water contact, and is useful to determine the direction of the boundary situation with respect to high-side and to give a distance estimate. This information is used for example to maintain drilling in a desired formation, without steering into neighboring zones. The new method provides information as to the direction the boundary is "approaching" from, without having to drill ahead further, by analyzing a few drill string rotations during which there is short hop communication.

In FIG. 10 a possible embodiment of an off-center antenna is shown. This antenna consists of one long, planar electrode strip embedded in an insulating material and is sitting on the side of an instrumented motor (Smart Motor) 311 or near bit sub. This allows driving or sensing currents or voltages between the electrode strip and the drill string. A lengthwise cross-sectional view of this Smart Motor antenna is shown in FIG. 11 where it is in close proximity of a shoulder bed 342 and facing towards the bed boundary. A transversal cross-section through such a short hop antenna is given in FIG. 12 again with the electrode strip pointing towards the boundary.

The off-center antenna preferably is located close to the drill bit to facilitate the ability to examine the formation as close to the bit as possible. Alternatively the asymmetric antenna could be located further up the BHA (borehole) without departing from the principles of the present invention.

Information is communicated from the gap by applying output voltage or current signals across the insulating gap. The current then flows from the upper region of the drill string through the formation to the lower section of the drill string. This current then causes a voltage difference between the lower end of the BHA and to off-center electrode (e.g. the Smart Motor electrode).

Referring now to FIGS. 18 and 19, the operation of the azimuthal boundary embodiment will now be described for the logging tool shown in FIG. 8. The two special orientations with an off-center antenna are when facing the boundary or pointing away from the boundary. FIG. 18 shows the current densities in the lengthwise cross-section of the drill string for the case where the electrode is pointing away from the boundary (i.e. is furthest away from the interface). The current densities are shown in FIG. 19 for the case where the electrode is facing towards the boundary. Note the higher current density at the gap compared to the case shown in FIG. 18. This higher current density results in a larger signal at the gap for the case when the electrode is facing toward the boundary.

Figure 20:
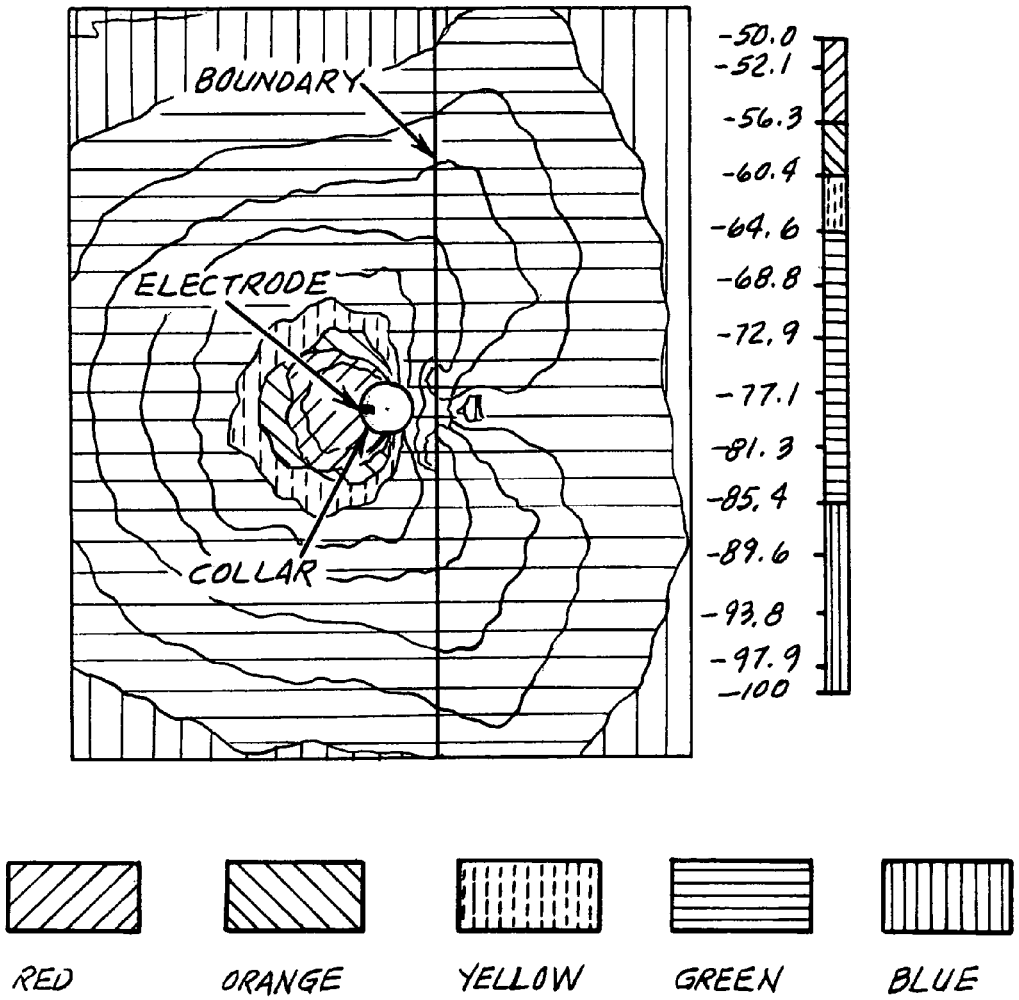
Figure 21:
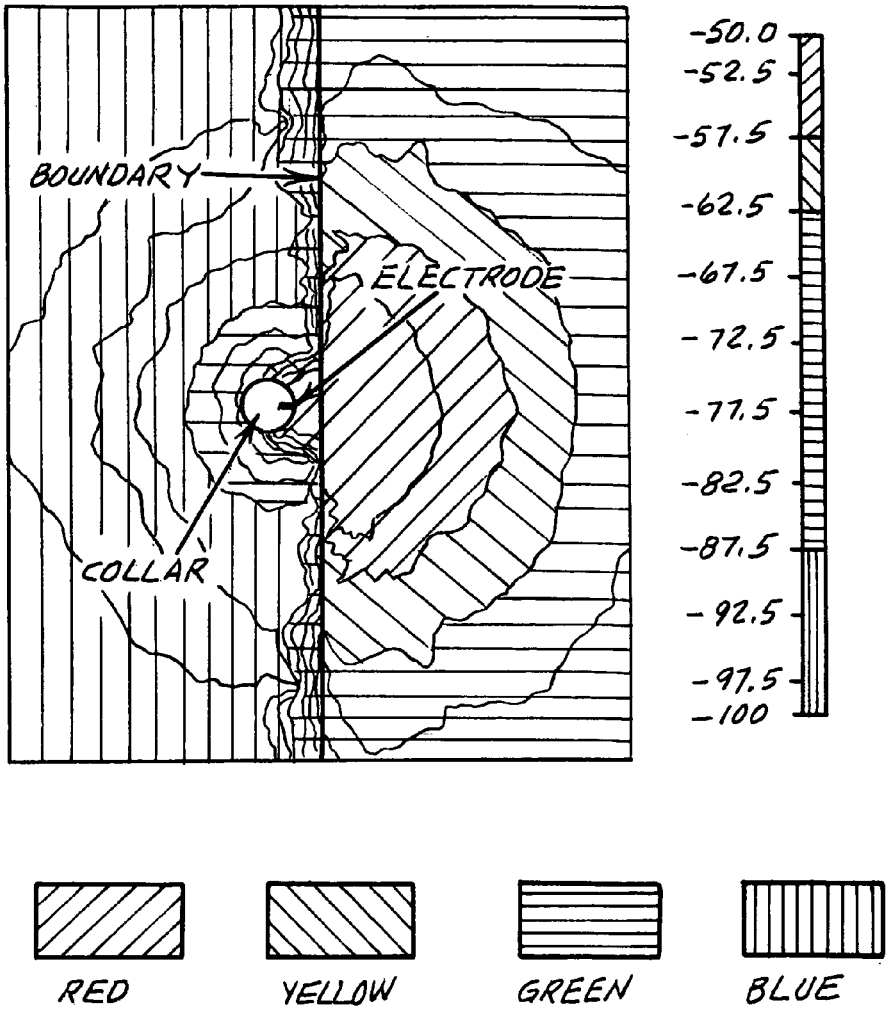

A transversal cross-section through the drill string and formation is shown in FIGS. 20 and 21 to illustrate the difference between the two particular orientations and the effect on the different current injection into the formation.

During normal drilling operation the BHA will be rotating and with it the off-center electrode. Let us consider the case where the BHA is in proximity to a boundary with enough resistivity contrast. If during rotation a transmission takes place, the signal strength will vary in an oscillatory way. FIGS. 14 and 15 show these variations normalized to the maximum value for each distance, as a function of angular position for different cases derived from finite element computer simulations. FIG. 14 shows the signal strength at the Gap with 1 Ωm mud and shoulder bed resistivity and 20 Ωm bed resistivity for two distances to the boundary (1 and 0.5 ft. from the BH (borehole) to the boundary). As a first order estimation of the signal dependence on orientation, a cosine function choice presents itself as applicable. A cosine fit to the simulation data is depicted therefore, for comparison, revealing that there is a pronounced deviation from this fit. The closer the electrode is to the boundary the more focused the sensitivity becomes, i.e. the higher the deviation from the cosine fit (see FIG. 14 and compare the curve for 1 and 0.5 ft. distance).

FIGS. 14 and 15 also show that the extremum (minimum or maximum) of the signal dependence function that has steeper adjacent slopes is marking the orientation where the electrode is facing the boundary. In other words, the signal strength function is more "pointed" where the electrode is closest to the boundary. In FIGS. 14 and 15 this orientation is at 0° (which is equal to the 360° orientation). Note that two cases are shown in FIG. 15 with the resistivity contrast being reversed. One case has a 20 Ωm bed and a 1 Ωm shoulder bed and the other case has a 1 Ωm bed and a 20 Ωm shoulder bed. The orientation where the electrode faces the boundary is still identified correctly, nevertheless, in that one is having a signal maximum and the other case is having a signal minimum at those orientations.

During employment of a short hop telemetry apparatus it is expected that the signal strength will vary in a periodic way, when rotating. The period of the signal variation depends on the rotation speed. With the available orientation information obtained from directional sensors it is possible to correlate signal strength and position of the off-center electrode at the time of transmission. Such directional measurements can be made by a three axis accelerometer or a three axis magnetometer which then can determine tool face angle of the tool.

A signal strength variation will be seen if the resistivity contrast between the target bed and the shoulder bed is high enough. FIG. 13 shows simulation results that quantify the amount of variation to be expected for different resistivity contrasts for a 1 ft. distance to the boundary. The variation shown in FIG. 13 is normalized to the mean of the two extreme values (e.g. facing towards and away from the boundary). A certain signal variation means±that value for the extremes (e.g. 130% and 70% for a 30% variation). Note that there is no variation when there is no resistivity contrast between the adjacent zones. The simulation results show a variation of up to ±30% for a distance of 1 ft which will increase when the BHA gets closer.

Figure 16:
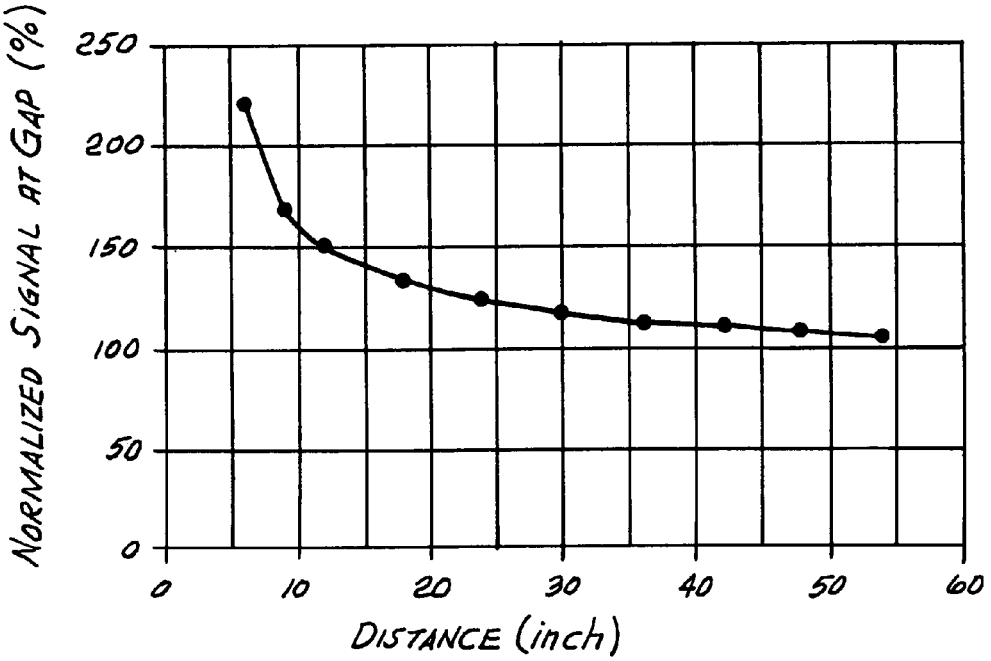
Figure 17:
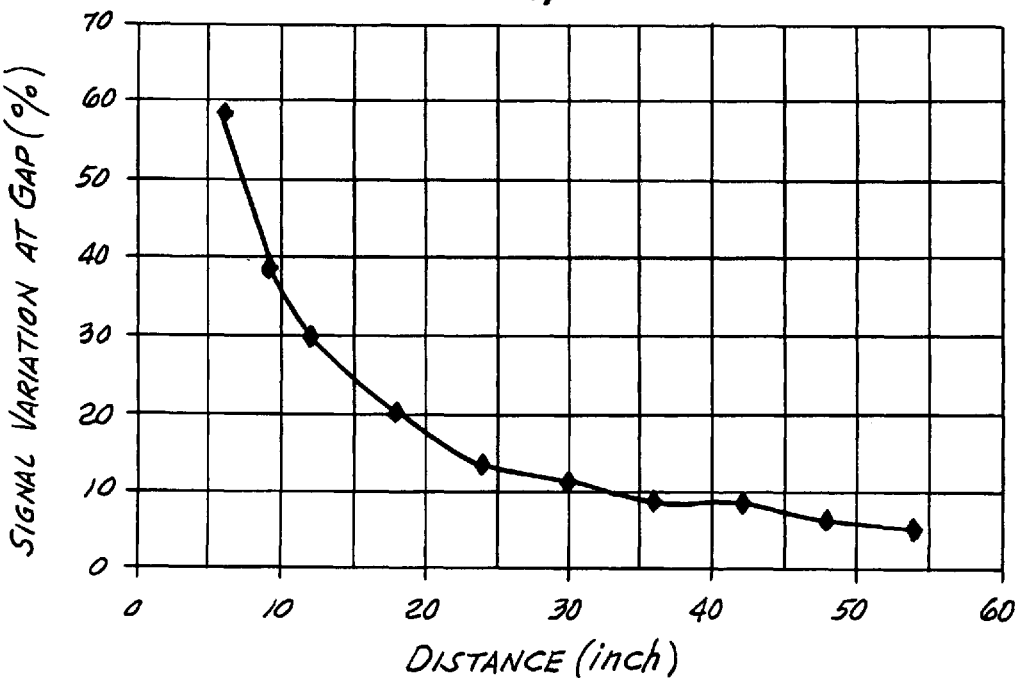

FIG. 16 shows the dependence on distance to the boundary of the simulated signal strength at the Gap with 1 Ωm shoulder bed resistivity and 20 Ωm bed resistivity for the electrode looking towards the boundary. The closer the boundary, the higher the signal. The signal is normalized to the case without boundary, i.e. normalized to the case where the boundary is sufficiently away from the BHA and has no influence on the signal strength.

There is signal variation between the extreme orientations (e.g. facing towards and away from the boundary) for a case with 1 Ωm shoulder bed resistivity and 20 Ωm bed resistivity for variable distance to the boundary. The closer the boundary the higher the signal variation at the Gap.

Given that the resistivities of the formations are known the signal strength (FIG. 16) or strength variations (FIG. 17) can be utilized to determine the proximity to a boundary. In the absence of resistivity information the signal strength or strength variation can still be useful, e.g. if during the course of the drilling procedure the boundary is approached and detected with an alternative method. In this case the signal levels and/or the signal variation can be used as a gauge for subsequent boundary distance estimations.

Figure 22:
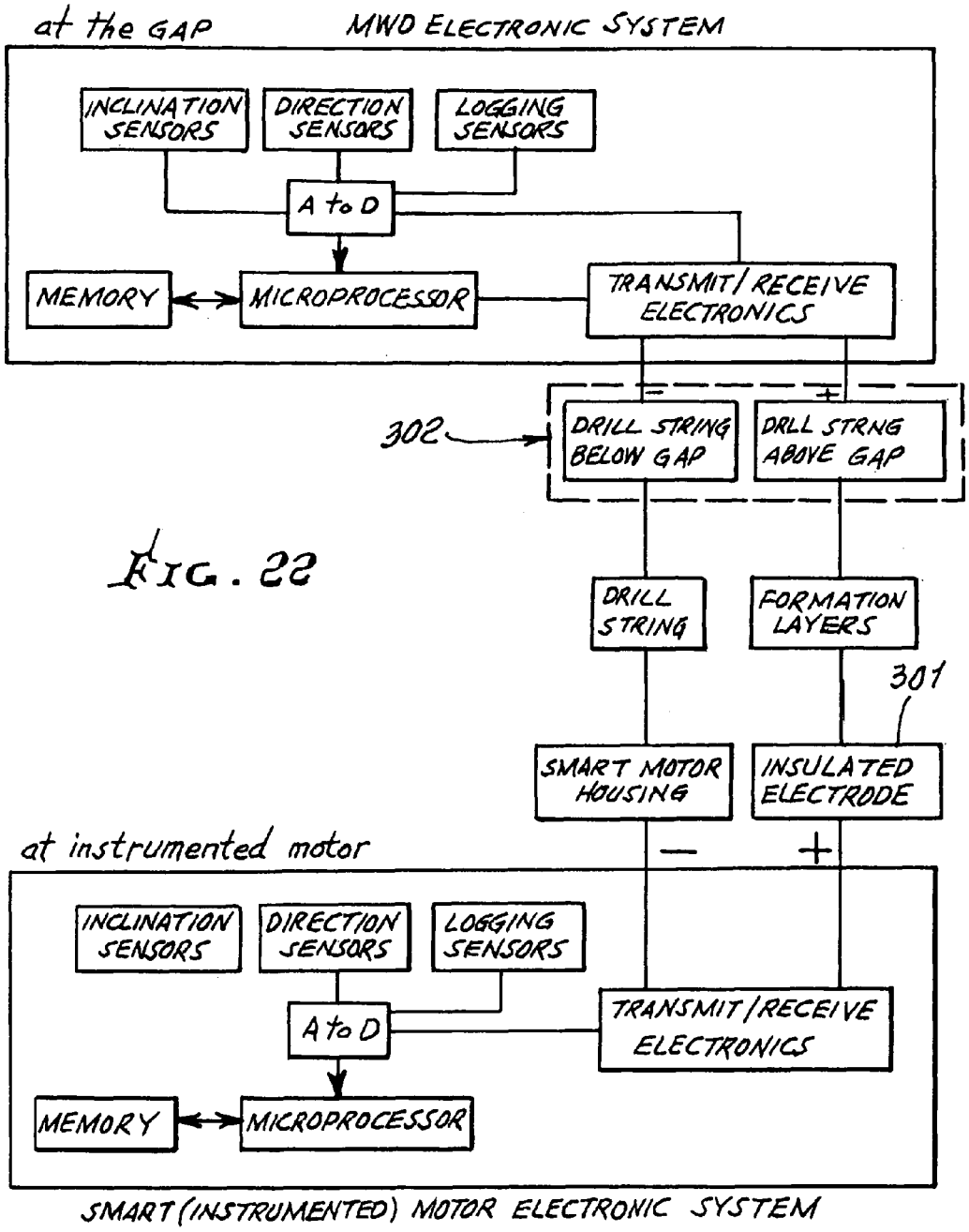
FIG. 22 is a block diagram.

FIG. 22 is a typical block diagram of circuitry incorporating the antenna electrode 301 and the gap 302 defined between drill string portions above and below the gap.

What is claimed is:

1. A method to detect the relative position of a drill bit with respect to a selected underground formation boundary or boundaries using an electric-field borehole telemetry apparatus, that includes the steps:

a) providing a measure-while-drilling apparatus that includes inclination sensors, directional sensors, logging sensors of choice and an electric-field borehole telemetry apparatus, b) within the electric-field borehole telemetry apparatus, in addition to monitoring the inclination, direction and logging parameters, monitoring one or more parameters of an electrical output of the electric-field borehole telemetry apparatus, c) transmitting to a surface computer the inclination, direction, and logging parameters as well as the one or more parameters of the electrical output by means of the electric-field borehole telemetry apparatus, d) computing drilling parameters to guide a drill string along an intended path, e) determining from the one or more transmitted parameters of the electrical output from the electric-field borehole telemetry apparatus parameters indicative of approaching or penetrating the selected formation boundary or boundaries, and f) making corrections to the direction of drilling to maintain the drill string and drill bit in the selected formation, g) the method including:

i) providing an insulating gap in lower end extent of the drill string, directly behind a drill collar thereby to maneuver the insulating gap to travel closely and in alignment with the bit in the selected formation, ii) applying output voltage derived from the measure while drilling apparatus to the insulating gap maintained with the drill bit in the selected formation to derive a voltage difference between electrical leads provided at the upper end of the drill string and in the earth at a distance from said upper end of the string.

2. The method of claim 1 wherein said selected formation comprises sub-surface material shale from which hydrocarbon production is expected.

3. The method of claim 1 wherein said electric-field borehole telemetry apparatus electrical output is driven by a voltage source and the said monitored parameter of the electrical output of the telemetry apparatus is the output current and the said parameter used to indicate approaching or penetrating a boundary is the said output current.

4. The method of claim 1 wherein said electric-field borehole telemetry apparatus electrical output is driven by a current source and the said monitored parameter of the electrical output of the telemetry apparatus is the output voltage and the said parameter used to indicate approaching or penetrating a boundary is the said output voltage.

5. The method of claim 1 wherein said electric-field borehole telemetry apparatus electrical output is driven by an electric source and the said monitored parameters of the electrical output of the telemetry apparatus are the output current and output voltage and the said parameter used to indicate approaching or penetrating a boundary is the driving point impedance, defined as the ratio of said output voltage to said output current.

6. A method to detect the relative position of a drill bit in a drill string with respect to a selected underground formation boundary or boundaries using an electric-field borehole telemetry apparatus, the steps that include:

a) providing a measure-while-drilling apparatus that includes inclination sensors, directional sensors, logging sensors of choice and an electric-field telemetry borehole telemetry apparatus, associated with the bit, b) providing an insulating gap in lower end extent of the drill string, c) applying output voltage derived from the measure while drilling apparatus to the insulating gap maintained in the selected formation to produce a voltage difference between electrical leads at the upper end of the string and in the earth at a distance from said upper end of the string, d) operating the electric-field telemetry apparatus for monitoring the inclination, direction and logging parameters, e) transmitting to a surface computer the inclination, direction, and logging parameters, including detecting at the surface the data transmitted and monitoring the signal strength received at the surface, f) computing drilling parameters needed to guide the drill string along an intended path, g) determining, from the produced voltage including voltage strength received at the surface computer, parameters indicative of drill bit deviation approaching or penetrating a boundary, and making corrections to the direction of drilling for maintaining the insulating gap and the terminal end of the drill string and drill bit, along with said insulating gap, in the selected formation, between boundaries thereof, the insulating gap maintained immediately behind a drill collar.

7. The method of claim 6 wherein said selected formation comprises sub-surface material from which hydrocarbon production is expected.

8. A method to detect the relative position of a drill bit with respect to a selected underground formation boundary using an electric-field borehole telemetry apparatus, said formation containing hydrocarbon, the steps that include:

a) providing a measure-while-drilling apparatus that includes inclination sensors, directional sensors, logging sensors of choice and an electric-field borehole telemetry apparatus, b) within the electric-field borehole telemetry apparatus having an electrical output, in addition to a monitoring of the inclination, direction, and logging parameters, monitoring one or more parameters of the electrical output of the electric-field borehole telemetry apparatus, c) transmitting to a surface computer the inclination, direction, and logging parameters as well as the one or more parameters of the electrical output by means of the electric-field borehole telemetry apparatus, d) detecting at the surface computer the inclination, direction, logging parameters, and the one or more parameters of the electrical output transmitted and monitoring the signal strength received at the surface, e) computing drilling parameters needed to guide a drill string along an intended path, f) determining from the one or more transmitted parameters of the electrical output from the electric-field borehole telemetry apparatus and a signal strength received at the surface computer, parameters indicative of drill bit approaching or penetrating the selected formation, and g) making corrections to the direction of drilling to maintain the drill bit in the selected formation, h) the method including:

i) providing an insulating gap in lower end extent of the drill string, directly behind a drill collar thereby to maneuver the insulating gap to travel with the drill bit in the selected formation, ii) applying output voltage derived from the measure while drilling apparatus to the insulating gap maintained in the selected formation in response to drill bit travel to produce a voltage difference between electrical leads at the upper end of the string and in the earth at a distance from said upper end of the string.

9. The method of claim 8 wherein said electric-field borehole telemetry apparatus electrical output is driven by a voltage source and the said monitored parameter of the electrical output of the telemetry apparatus is the output current and the said parameter used to indicate bit approaching or penetrating said boundary is the said output current.

10. The method of claim 8 wherein said electric-field borehole telemetry apparatus electrical output is driven by a current source and the said monitored parameter of the electrical output of the telemetry apparatus is the output voltage and the said parameter used to indicate bit approaching or penetrating said boundary is the said output voltage.

11. The method of claim 8 wherein said electric-field borehole telemetry apparatus electrical output is driven by an electric source and the monitored parameters of the electrical output of the telemetry apparatus are the output current and output voltage and the parameter used to indicate bit approaching or penetrating said boundary is a driving point impedance, defined as a ratio of said output voltage to said output current.

12. The method of claim 11 wherein means is provided to transmit commands from the surface computer to the downhole elements of said electric-field borehole telemetry apparatus and including the additional step of transmitting downward via said means a command to the said downhole electric-field borehole telemetry apparatus to increase the output current, the output voltage or a signal time duration so as to increase a signal-to-noise ratio of the observed parameters.

* * * * *